US007543716B2

(12) United States Patent
Lin

(10) Patent No.: US 7,543,716 B2
(45) Date of Patent: Jun. 9, 2009

(54) GARBAGE BIN

(76) Inventor: Tsong-Yow Lin, No. 57-1, Yung Ho Street, Yung Ho Village, Ta Tu Hsiang, Taichung Hsien (TW)

( * ) Notice: Subject to any disclaimer, the term of this patent is extended or adjusted under 35 U.S.C. 154(b) by 234 days.

(21) Appl. No.: 11/456,105

(22) Filed: Jul. 7, 2006

(65) Prior Publication Data

US 2008/0000912 A1 Jan. 3, 2008

(30) Foreign Application Priority Data

Jun. 29, 2006 (TW) ..... 95211414 U

(51) Int. Cl.
*B65D 25/14* (2006.01)

(52) U.S. Cl. ..... 220/495.11; 220/495.06; 220/495.08; 220/908; 220/262; 220/263; 141/391

(58) Field of Classification Search ..... 220/495.06, 220/495.08, 495.11, 908, 262, 263, 264; 141/391

See application file for complete search history.

(56) References Cited

U.S. PATENT DOCUMENTS 1,953,042 A * 3/1934 Cody ..... 414/419
2,475,125 A * 7/1949 Brownell ..... 220/263
3,261,545 A * 7/1966 Frazier ..... 232/43.2
3,561,077 A * 2/1971 Grant ..... 248/95
3,779,419 A * 12/1973 Heitz ..... 220/495.11
3,870,261 A * 3/1975 McSwain ..... 248/101
3,893,649 A * 7/1975 Cornell et al. ..... 248/99
4,158,424 A * 6/1979 Carmack ..... 220/826
4,238,868 A * 12/1980 Sternberg ..... 15/257.4
4,325,492 A * 4/1982 Kunze ..... 220/831
4,361,247 A * 11/1982 Williams ..... 220/88.1
4,411,300 A * 10/1983 Rico ..... 383/33
4,488,697 A * 12/1984 Garvey ..... 248/101
4,630,752 A * 12/1986 DeMars ..... 220/495.08
4,753,367 A * 6/1988 Miller et al. ..... 220/495.11
4,765,579 A * 8/1988 Robbins et al. ..... 248/101
4,913,308 A * 4/1990 Culbertson ..... 220/495.09
4,953,740 A * 9/1990 Koda ..... 220/263
4,955,566 A * 9/1990 Bolich ..... 248/101
5,119,960 A * 6/1992 Robbins, III ..... 220/640
5,269,435 A * 12/1993 Hallock, III ..... 220/495.08
5,476,187 A * 12/1995 Marisco ..... 220/495.08
5,478,152 A * 12/1995 Bogle ..... 383/33
5,570,862 A * 11/1996 Nugent ..... 248/97
5,662,238 A * 9/1997 Sarno ..... 220/495.11
5,913,496 A * 6/1999 Valdez ..... 248/99
5,971,194 A * 10/1999 Freedland ..... 220/495.08
6,209,596 B1 * 4/2001 Wong ..... 141/391
6,416,023 B1 * 7/2002 Satsky ..... 248/99
6,679,462 B1 * 1/2004 Valdez ..... 248/99

(Continued)

OTHER PUBLICATIONS

Taiwanese Patent M261490, Apr. 11, 2005, 8 pages.

*Primary Examiner*—Anthony D Stashick
*Assistant Examiner*—Christopher B McKinley
(74) *Attorney, Agent, or Firm*—Alan Kamrath; Kamrath & Associates PA

(57) ABSTRACT

A garbage-containing device includes a bin, a first ring and a second ring. The first ring is installed on the bin. The second ring is pivotally installed on the first ring. An upper edge of a bag can be clamped between the first and second rings.

20 Claims, 9 Drawing Sheets

U.S. PATENT DOCUMENTS 6,739,474 B1 * 5/2004 Wang ..... 220/831
7,121,421 B2 * 10/2006 Yang et al. ..... 220/263
7,225,943 B2 * 6/2007 Yang et al. ..... 220/263
7,290,674 B1 * 11/2007 Ledford ..... 220/507
7,350,547 B2 * 4/2008 Quiring ..... 141/391

* cited by examiner

GARBAGE BIN

BACKGROUND OF INVENTION

1. Field of the Invention

The present invention relates to a garbage bin and, more particularly, to a device for holding a garbage bag in a garbage bin.

2. Related Prior Art

Disclosed in Taiwanese Patent M261490 is a bin 1 capable of holding a bag. Referring to FIGS. 1 and 2 of the patent, the bin 1 includes an opening 11 at an upper end and two enhanced portions 15 near the upper end. A bag-holding device 2 is installed on the bin 1. The bag-holding device 2 is made corresponding to the opening 11. The bag-holding device 2 includes two arched frames 21 and 22. Each of the frames 21 and 22 includes two ends each formed with a lug 23. A fastener 3 is driven into one of the lugs 23 of the frame 21, a related one of the lugs 23 of the frame 22 and a related one of the enhanced portions 15. Thus, the frames 21 and 22 are pivotally installed on the bin 1.

Referring to FIGS. 3 and 4 of the patent, the frames 21 and 22 are lifted. An upper edge of a bag 6 is inserted through the bag-holding device 2 and retroflexed so that it wraps the bag-holding device 2. The frames 21 and 22 are released.

Referring to FIG. 5 of the patent, the frames 21 and 22 are lifted. The upper edge of the bag 6 is inserted through a gap between the bin 1 and the bag-holding device 2 and retroflexed so that it wraps the bag-holding device 2. The frames 21 are 22 released.

Some problems have been encountered during the use of the bin 1 and the bag-holding device 2. Firstly, a user must carefully lower the upper edge of the bag 6 and the frames 21 and 22 to ensure that the upper edge of the bag 6 wraps the frames 21 and 22. This is inconvenient. Otherwise, the frames 21 and 22 might leave the upper edge of the bag 6, because the former might fall while the latter might stay since the weight of the latter might be encountered by the friction between the latter and the bin 1. Secondly, the upper edge of the bag 6 might be disengaged from the frames 21 and 22 after containing some garbage if the depth of the bag 6 is smaller than that of the bin 1.

Referring to FIG. 9, a conventional garbage-containing device 120 includes a bin 130, a cover 140, a first ring 150 and a second ring 160. The cover 140 is pivotally installed on the bin 130. The first ring 150 includes an internal flange 151 and an external flange 152. The external flange 152 of the first ring 150 is located on an upper edge of the bin 130. An upper edge 171 of a bag 170 is inserted through the second ring 160 and retroflexed so that the former wraps the latter. The upper edge 171 of the bag 170 and the second ring 160 are located on the internal flange 151 of the first ring 150. Thus, the upper edge 171 of the bag 170 is clamped between the internal flange 151 of the first ring 150 and the second ring 160.

Some problems have been encountered during the use of the conventional garbage-containing device 120. Firstly, as an independent element, the second ring 160 can easily be lost. Secondly, the upper edge 171 of the bag 170 might be disengaged from the rings 150 and 160 after containing some garbage if the depth of the bag 170 is smaller than that of the bin 130.

Therefore, the present invention is intended to obviate or at least alleviate the problems encountered in the prior art.

SUMMARY OF INVENTION

According to the present invention, a garbage-containing device includes a bin, a first ring and a second ring. The first ring is installed on the bin. The second ring is pivotally installed on the first ring. An upper edge of a bag can be clamped between the first and second rings.

It is an advantage of the garbage-containing device of the present invention to ensure its integrity, since the second ring is pivotally connected to the first ring and, hence, will not be lost.

It is another advantage of the garbage-containing device of the present invention to ensure the positioning of the bag, since the upper edge of the bag is clamped between the first and second rings.

Other advantages and features of the present invention will become apparent from the following description referring to the drawings.

BRIEF DESCRIPTION OF DRAWINGS

The present invention will be described through detailed illustration of two embodiments referring to the drawings.

DETAILED DESCRIPTION OF EMBODIMENTS

Figure 1:
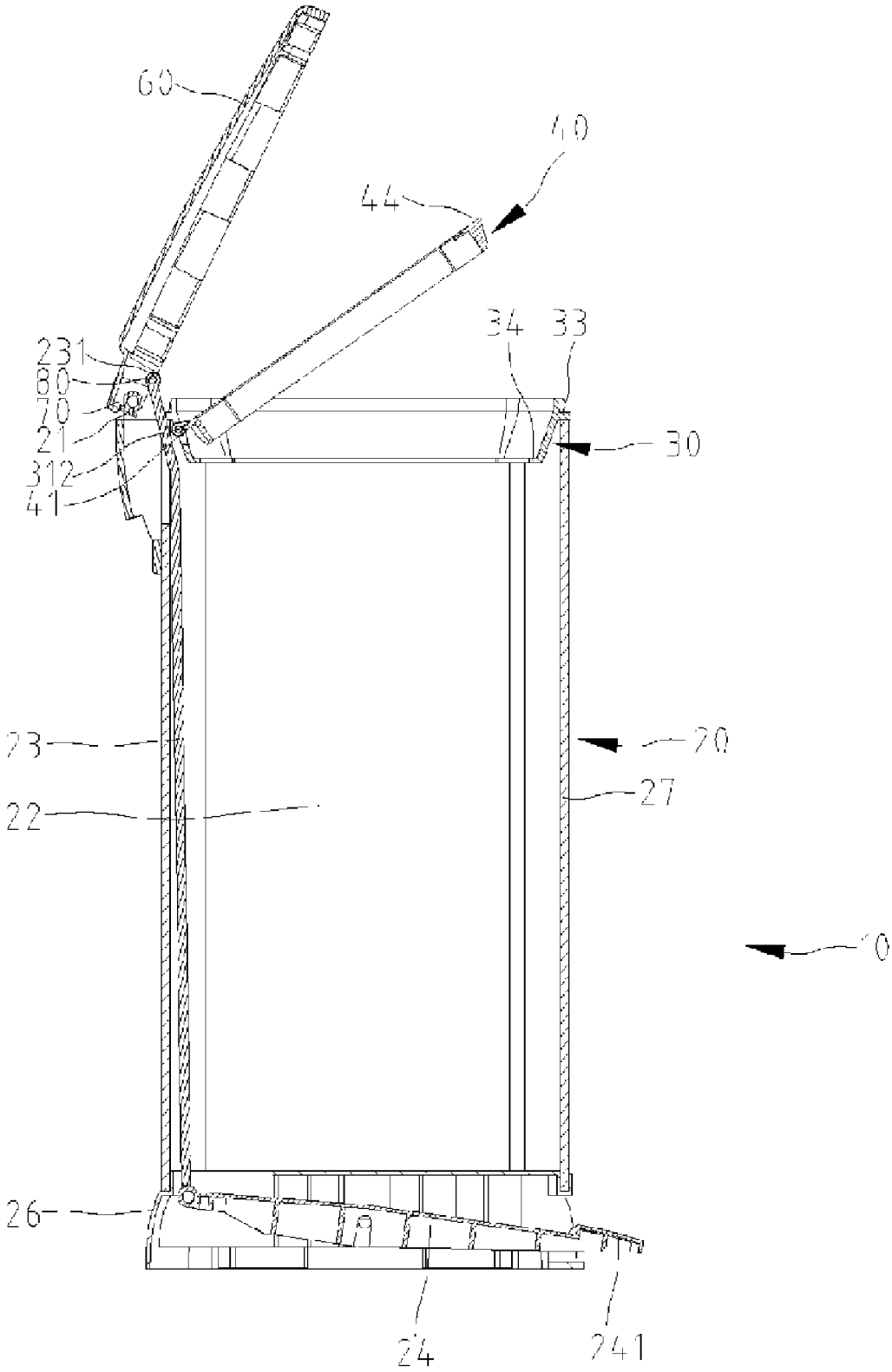
FIG. 1 is a cross-sectional view of a garbage-containing device according to the first embodiment of the present invention.
Figure 2:
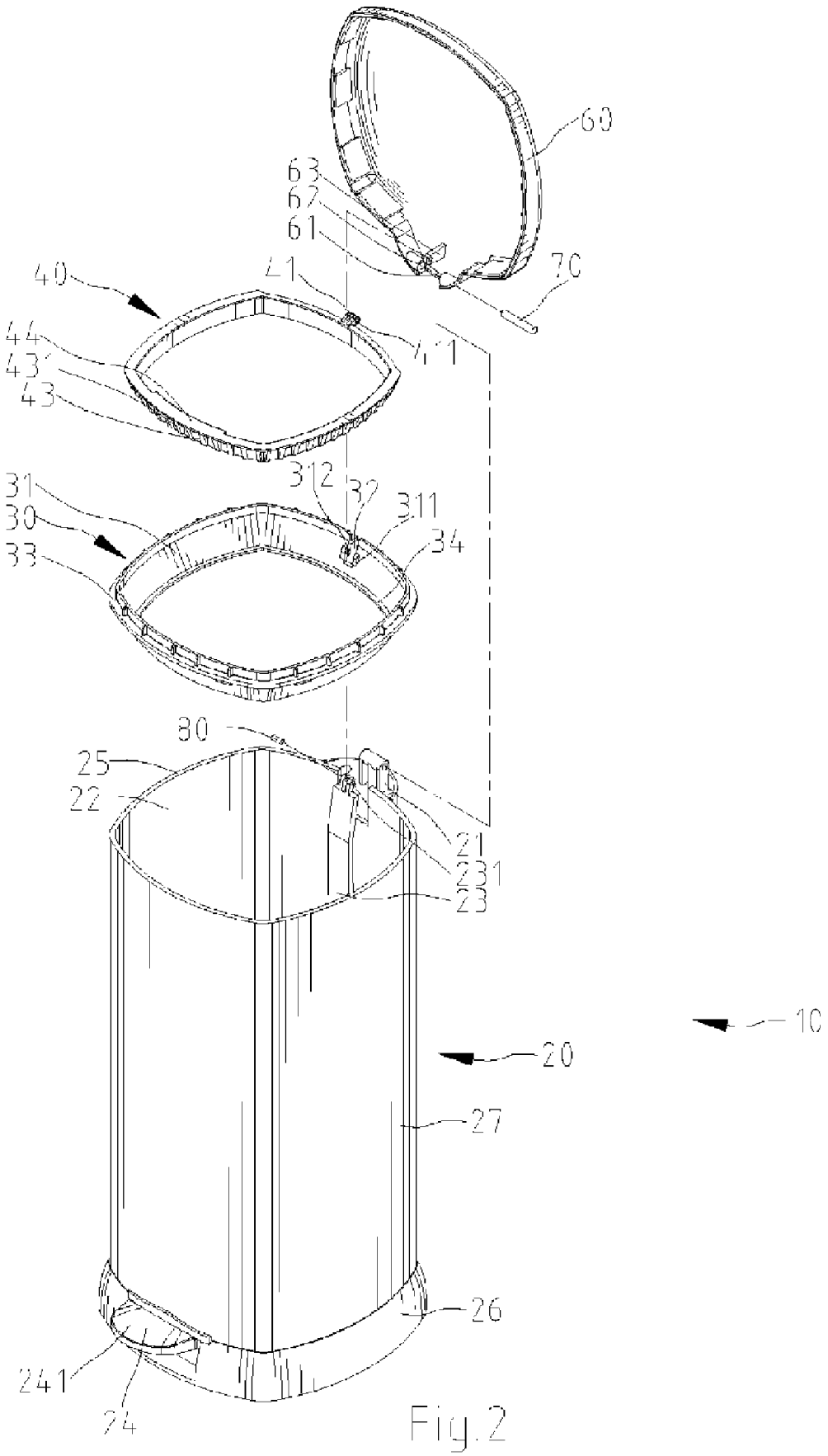
FIG. 2 is an exploded view of the garbage-containing device shown in FIG. 1.

Referring to FIGS. 1 and 2, there is shown a garbage-containing device 10 according to a first embodiment of the present invention. The garbage-containing device 10 includes a bin 20, a first ring 30, a second ring 40 and a cover 60.

The bin 20 includes a base 26 and a barrel 27 installed on the base 26. The barrel 27 defines a space 22 and includes an upper edge 25 and a connective portion 21 near the upper edge 25.

The cover 60 includes two sleeves 62 formed on a lower side and separated by a gap 61 and a lug 63 formed on the lower side.

The cover 60 is installed on the barrel 27. The connective portion 21 of the barrel 27 is located between the sleeves 62 of the cover 60. A pin 70 is fit in the sleeves 62 of the cover 60 and the connective portion 21 of the barrel 27, thus pivotally installing the cover 60 on the barrel 27.

A pedal 24 is pivotally installed on the base 26 and, more specifically, between the base 26 and the barrel 27. The pedal 24 includes, at an end, a tread 241 exposed from the base 26 and barrel 27. A rod 23 includes a lower end pivotally connected to an opposite end of the pedal 24 and an upper end formed with two lugs 231 pivotally connected to the lug 63 of the cover 60 by a pin 80.

The first ring 30 includes a wall 31, an external flange 33 formed on an external side of the wall 31 and an internal flange 34 formed on an internal side of the wall 31. The wall 31 defines a slit 32. There are two lugs 311 formed on an internal side of the wall 31 so that the slit 32 is located between the lugs 311. Each of the lugs 311 is formed with a boss 312. The external flange 33 is installed on the upper edge 25 of the barrel 27.

The second ring 40 includes two lugs 41 formed on an external side, an abutting portion 43 formed on the external side and a handle 44 formed on an internal side. Each of the lugs 41 defines a recess 411. The abutting portion 43 includes a plurality of teeth 431.

A lower edge of the second ring 40 is located on the internal flange 34 of the first ring 30. The lugs 41 of the second ring 40 are located between the lugs 311 of the first ring 30. The bosses 312 of the first ring 30 are inserted in the recesses 411 of the second ring 40. Thus, the second ring 40 is pivotally installed on the first ring 30.

Figure 3:
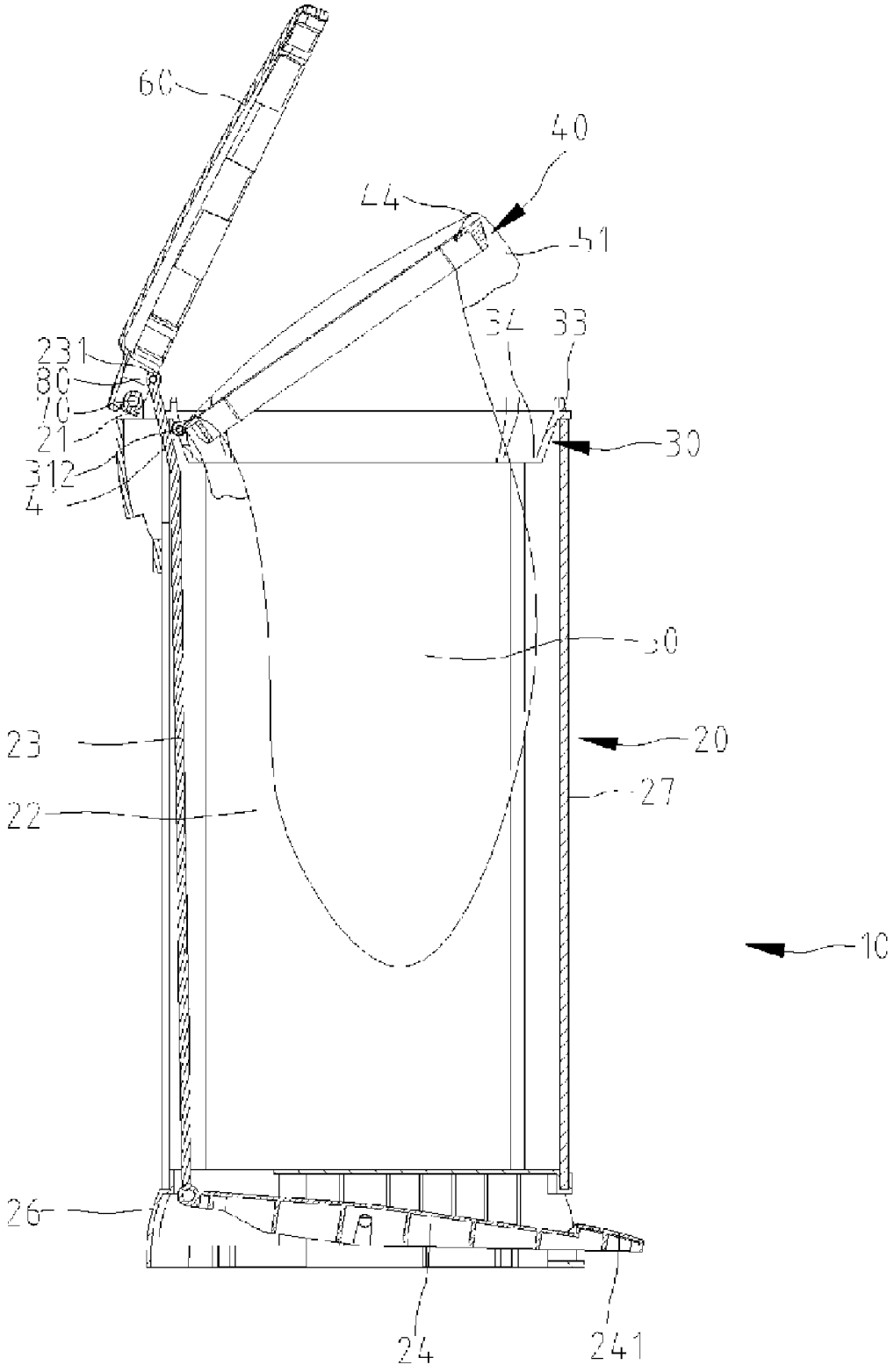
FIG. 3 is a cross-sectional view of a bag to be installed on the garbage-containing device shown in FIG. 1.

Referring to FIG. 3, the tread 241 of the pedal 24 is trodden so that the cover 60 is lifted. The second ring 40 is lifted by the handle 44. A bag 50 is inserted in the barrel 27 through the second ring 40. An upper edge 51 of the bag 50 is retroflexed so that it wraps the second ring 40.

Figure 4:
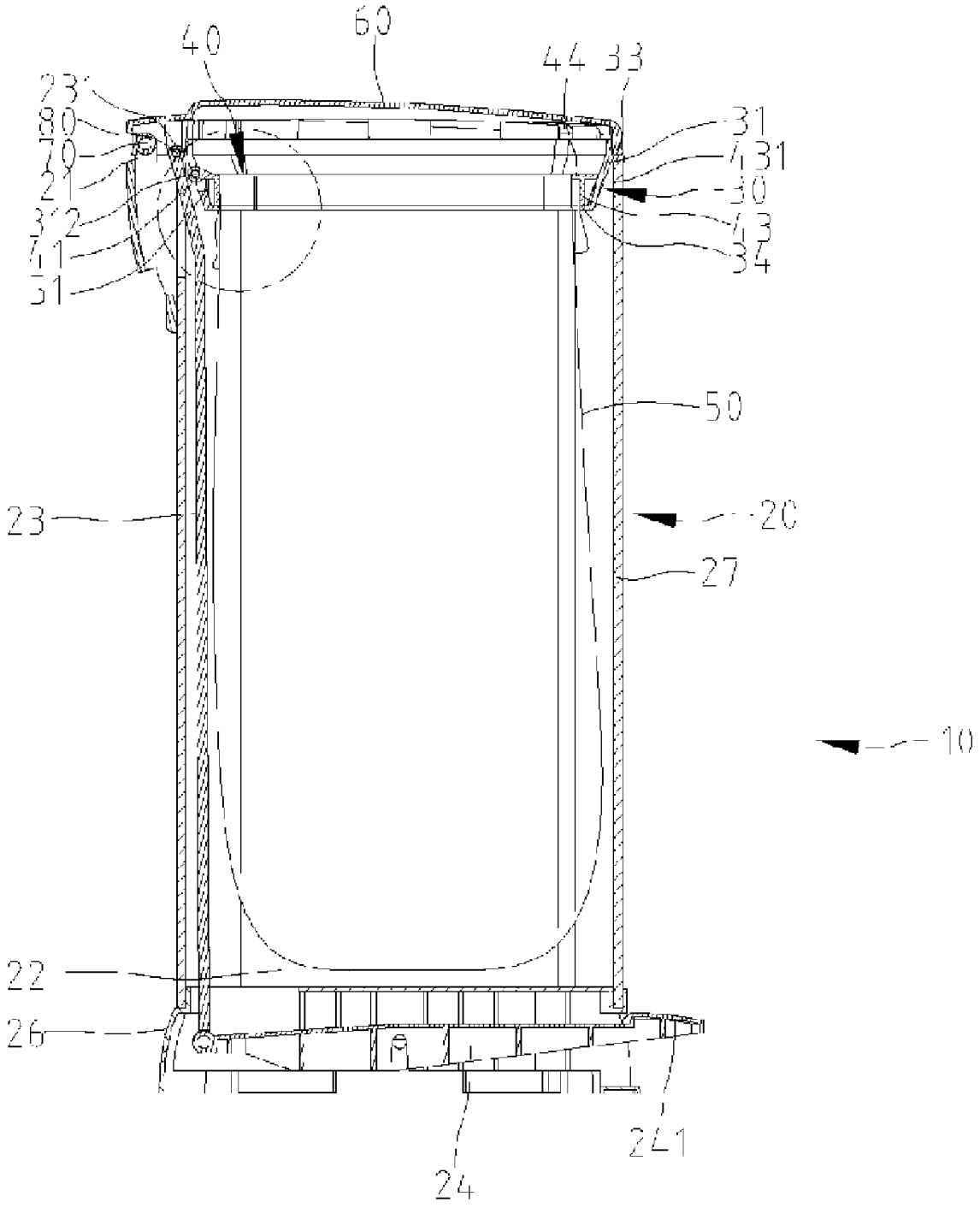
FIG. 4 is a cross-sectional view of the bag installed on the garbage-containing device shown in FIG. 3.
Figure 5:
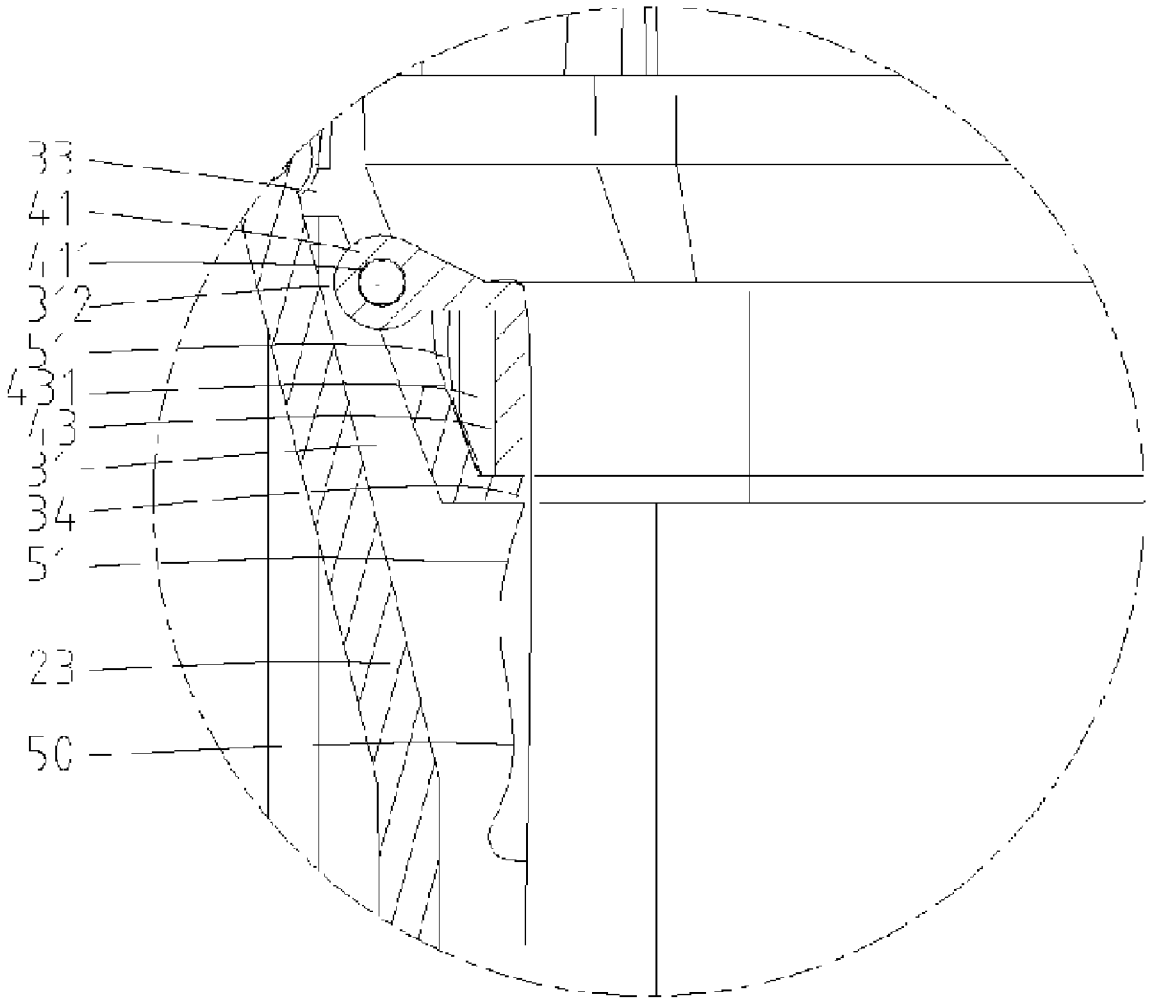
FIG. 5 is an enlarged partial cross-sectional view of the bag installed on the garbage-containing device shown in FIG. 4.

Referring to FIGS. 4 and 5, the tread 241 of the pedal 24 is released so that the cover 60 is returned. The second ring 40 is released. The upper edge 51 of the bag 50 is clamped between the second ring 40 and the first ring 30 and, more specifically, between the teeth 431 of the abutting portion 43 formed on the external side of the second ring 40 and the internal side of the first ring 30.

Figure 6:
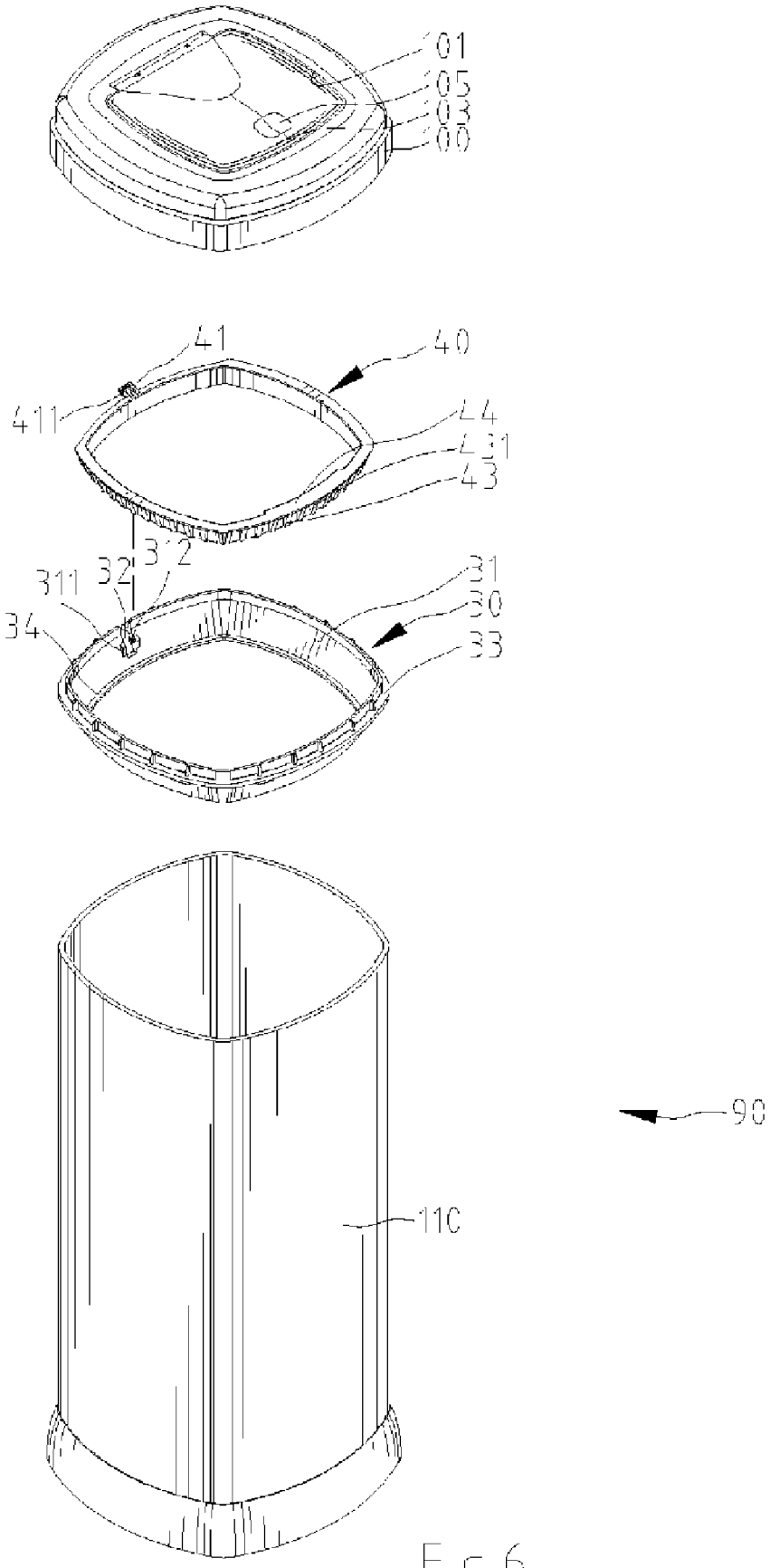
FIG. 6 is an exploded view of a garbage-containing device according to the second embodiment of the present invention.
Figure 7:
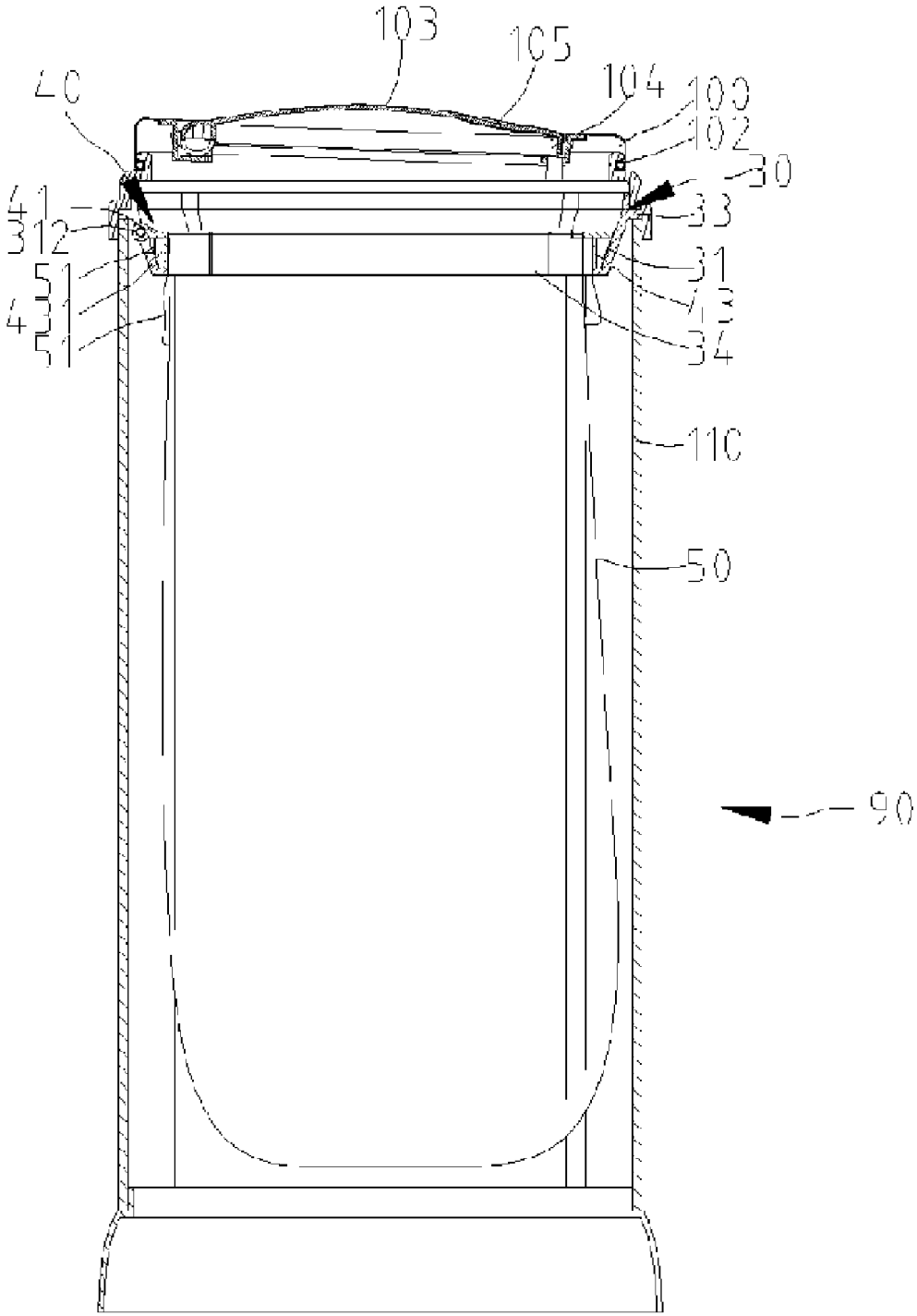
FIG. 7 is a cross-sectional view of a bag installed on the garbage-containing device shown in FIG. 6.
Figure 8:
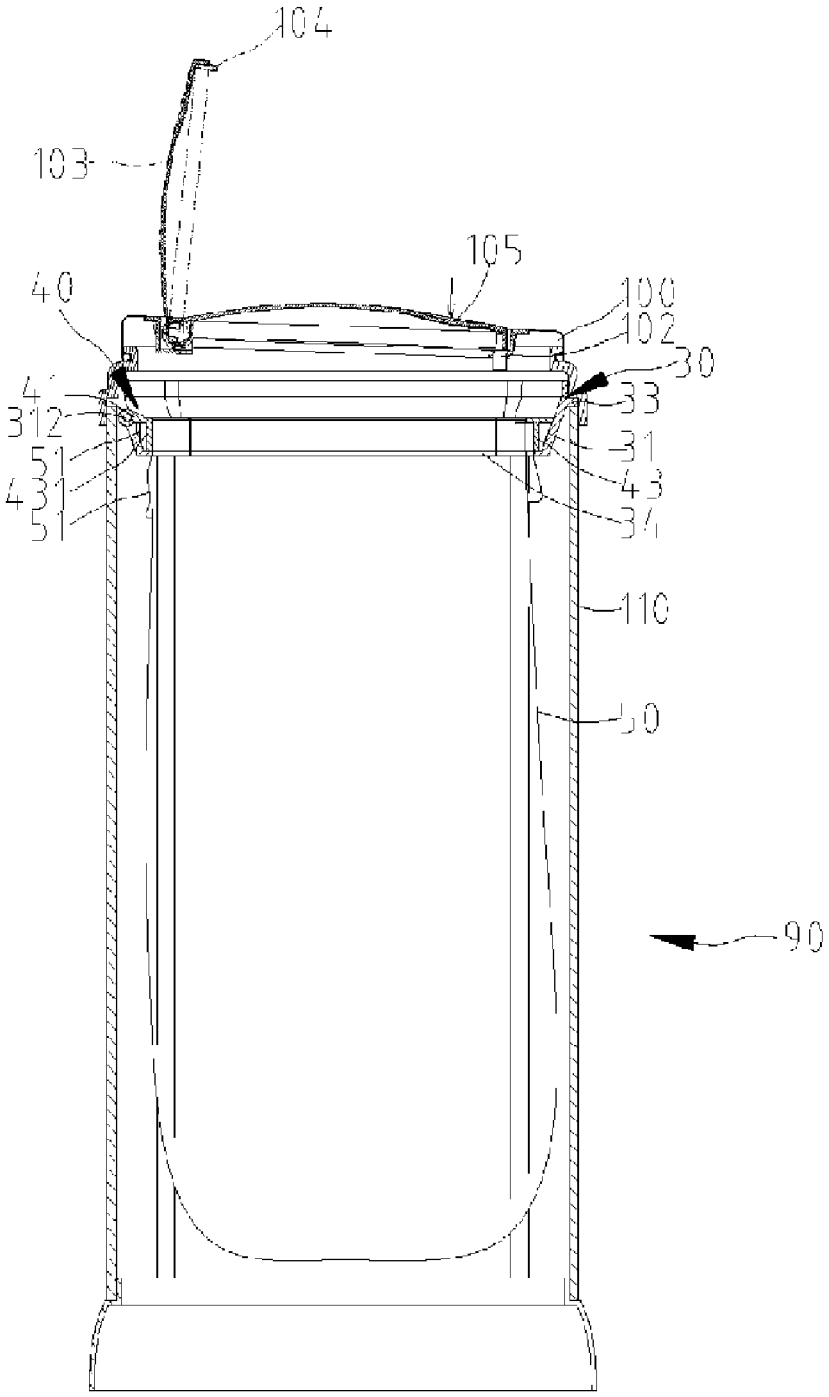
FIG. 8 is a cross-sectional view of the garbage-containing device in another position than shown in FIG. 7.
Figure 9:
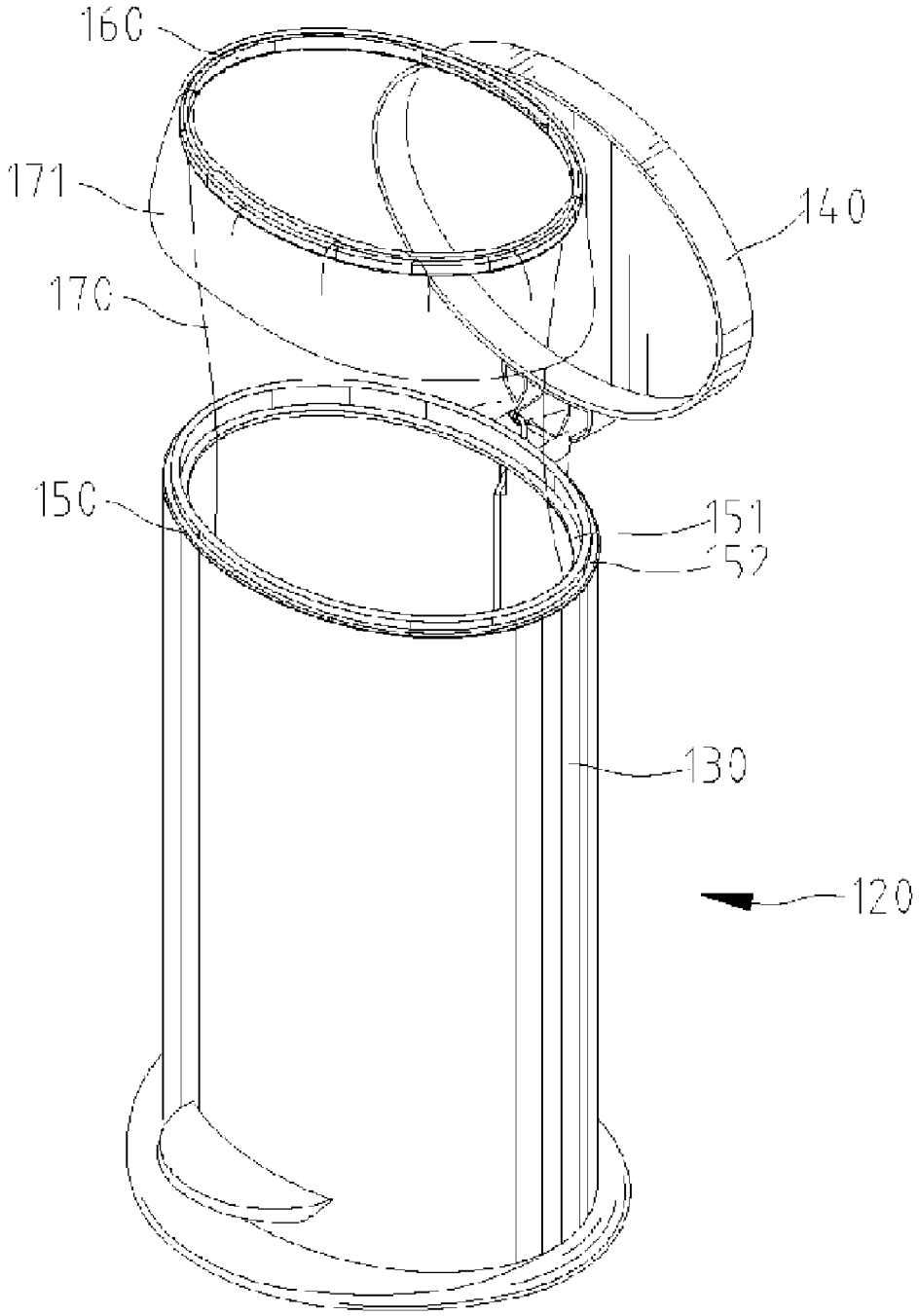
Fig.9 PRIOR ART
FIG. 9 is a perspective view of a conventional garbage-containing device.

Referring to FIGS. 6 through 8, there is shown a garbage-containing device according to a second embodiment of the present invention. The second embodiment is like the first embodiment except two things. Firstly, there is used a bin 90 instead of the bin 20. The bin 90 includes a barrel 110 installed on a base. Secondly, there is used a cover assembly 100 instead of the cover 60. The cover assembly 100 includes a frame 101 installed on the barrel 110 and a cover 103 pivotally installed on the frame 101. The frame 101 defines an opening. A lock 102 is installed on the frame 101. The cover 103 closes the opening defined in the frame 101. A tongue 104 is extended from the cover 103. The cover 103 includes a touch portion 105.

Referring to FIG. 7, the opening defined in the frame 101 is closed by the cover 103. The tongue 104 is inserted and retained in the lock 102. Thus, the cover 103 is locked to the frame 101.

Referring to FIG. 8, the touch portion 105 is pushed so that the tongue 104 is released from the lock 102. The cover 103 is lifted from the frame 101. The opening defined in the frame 101 is opened.

The garbage-containing device according to the present invention exhibits several advantages. Firstly, its integrity is ensured since the second ring 40 is pivotally connected to the first ring 30 and hence will not be lost. Secondly, the bag 50 is firmly positioned, since its upper edge 51 is clamped between the teeth 431 of the abutting portion 43 of the second ring 40 and the first ring 30. Thirdly, the structure is simple. Fourthly, the operation is easy.

The present invention has been described via the detailed illustration of the embodiments. Those skilled in the art can derive variations from the embodiments without departing from the scope of the present invention. Therefore, the embodiments shall not limit the scope of the present invention defined in the claims.

What is claimed is:

1. A garbage-containing device comprising a bin, a first ring installed on the bin, and a second ring pivotally installed on the first ring at a pivot point, with the first ring including an annular wall having an upper edge, a lower edge, and an internal side, with the internal side located inside of the bin, with the pivot point located inwardly of the internal side and intermediate the upper and lower edges, with the second ring pivotal about the pivot point between a bag clamping position and a bag insertion position, with the second ring located completely within the internal side of the wall of the first ring in the bag clamping position so that an upper edge of a bag can be clamped between the internal side of the first ring and the second ring, with the second ring being at a non parallel angle to the first ring in the bag insertion position.

2. The garbage containing device according to claim 1, with the bin having a free upper edge, wherein the first ring has an internal flange formed on the internal side adjacent to the lower edge of the first ring, with the second ring located on the internal flange in the bag clamping position, with the internal flange extending parallel to the upper edge of the bin.

3. The garbage containing device according to claim 2, wherein the first ring is removably installed on the bin, with the annular wall having an external side, with the first ring including an external flange formed on the external side and abutting with the free upper edge of the bin, with the external side of the first ring located within the bin, with the external flange being parallel to and spaced from the internal flange.

4. The garbage-containing device according to claim 3 wherein the second ring comprises an abutting portion formed thereon abutting with the internal side of the annular wall between the upper and lower edges in the bag clamping position for firm abutment against the upper edge of the bag.

5. The garbage-containing device according to claim 4 wherein the abutting portion includes a plurality of teeth at spacings completely around the second ring.

6. The garbage-containing device according to claim 3 wherein the pivot point of the first ring comprises at least one lug formed on the internal side and extending toward the second ring, wherein the second ring comprises at least one lug formed thereon and pivotally connected to the lug of the first ring at the pivot point.

7. The garbage-containing device according to claim 6 wherein the at least one lug of the first ring comprises a boss formed thereon, wherein the at least one lug of the second ring defines a recess for receiving the boss of the first ring.

8. The garbage-containing device according to claim 6 wherein the at least one lug of the first ring comprises two lugs, wherein the at least one lug of the second ring comprises two lugs pivotally connected to the two lugs of the first ring.

9. The garbage-containing device according to claim 8 wherein each of the two lugs of the first ring comprises a boss formed thereon, wherein each of the two lugs of the second ring defines a recess for receiving the boss of a related one of the two lugs of the first ring.

10. The garbage-containing device according to claim 6 wherein the second ring comprises an abutting portion formed thereon abutting with the internal side of the annular wall between the upper and lower edges in the bag clamping position for firm abutment against the upper edge of the bag.

11. The garbage-containing device according to claim 10 wherein the abutting portion includes a plurality of teeth at spacings completely around the second ring.

12. The garbage-containing device according to claim 3 comprising a cover pivotally installed on the bin.

13. The garbage-containing device according to claim 12 wherein the cover comprises two sleeves formed thereon, wherein the bin comprises a connective portion formed thereon and located between the two sleeves of the cover, wherein the garbage-containing device further comprises a pin driven in the connective portion of the bin through the two sleeves of the cover.

14. The garbage-containing device according to claim 12 comprising a pedal and a rod for connecting the cover to the pedal so that the cover is lifted when the pedal is trodden.

15. The garbage-containing device according to claim 14 wherein the cover comprises at least one lug formed thereon, wherein the rod comprises at least one lug formed thereon and pivotally connected to the lug of the cover.

16. The garbage-containing device according to claim 15 comprising a pin fit in the at least one lug of the cover and the at least one lug of the rod.

17. The garbage-containing device according to claim 3 comprising a cover assembly installed on the bin.

18. The garbage-containing device according to claim 17 wherein the cover assembly comprises a frame installed on the bin and a cover pivotally installed on the frame.

19. The garbage-containing device according to claim 18 wherein the frame comprises a lock installed thereon, wherein the cover comprises a tongue installed thereon for releasable insertion in the lock of the frame.

20. The garbage-containing device according to claim 19 wherein the cover comprises a touch portion so that the tongue of the cover is released from the lock of the frame when the touch portion of the cover is pushed.

* * * * *